US006182329B1

(12) United States Patent
Lin

(10) Patent No.: US 6,182,329 B1
(45) Date of Patent: Feb. 6, 2001

(54) PORTABLE AIR BLOWER

(76) Inventor: Ching-Chih Lin, No. 1, Alley 25, Lane 25, Kuo-Chung 1 Rd., Ta-Li City, Taichung Hsien (TW)

( * ) Notice: Under 35 U.S.C. 154(b), the term of this patent shall be extended for 0 days.

(21) Appl. No.: 09/336,911

(22) Filed: Jun. 21, 1999

(51) Int. Cl.[7] ..... A47L 5/06
(52) U.S. Cl. ..... 15/343; 15/405; 417/239
(58) Field of Search ..... 15/342, 343, 344, 15/405; 417/234

(56) References Cited

U.S. PATENT DOCUMENTS 879,580 * 2/1908 Pearsall ..... 15/342
1,666,350 * 4/1928 Pitt ..... 15/344
1,668,357 * 5/1928 Davenes ..... 15/343

* cited by examiner

*Primary Examiner*—Terrence R. Till
(74) *Attorney, Agent, or Firm*—Gardere & Wynne, L.L.P.; Sanford E. Warren, Jr.

(57) ABSTRACT

A portable air blower includes a housing having an air inlet and an air outlet, a fan rotatably mounted in the housing, a gear train attached to the housing to rotate the fan, a drive shaft having a first end and a second end, the first end secured to the gear train to operate the gear train, and a crank arm secured to the second end of the drive shaft to rotate the drive shaft manually.

6 Claims, 4 Drawing Sheets

PORTABLE AIR BLOWER

CROSS-REFERENCES TO RELATED APPLICATIONS

Not Applicable.

BACKGROUND OF THE INVENTION

1.Field of the Invention

The present invention relates to a portable air blower.

2.Description of the Related Art

People often start charcoal fires in barbeque grills when participating in outdoor recreation. However, they often use articles such as newspapers or paper plates to fan the fire. In such a manner, not only is it necessary to manually fan the fire that requires a lot of energy, the air does not go where it is most needed, at the base of the fire. The present invention has arisen to solve the these problems.

BRIEF SUMMARY OF THE INVENTION

In accordance with one aspect of the present invention, a portable air blower comprises a housing including an air inlet and an air outlet, a fan rotatably mounted in the housing, a gear train attached to the housing to rotate the fan, a drive shaft having a first end and a second end, the first end secured to the gear train to operate the gear train, and a crank arm secured to the second end of the drive shaft to rotate the drive shaft.

The housing includes two casing halves coupled with each other, each of the two casing halves containing an air inlet near the center. The fan includes a driven shaft having a first end secured in the fan to rotate the fan, and a second end extending out through a one of the casing halves. The gear train includes a drive pinion secured on the second end of the driven shaft to rotate the driven shaft, a drive gear meshing with the drive pinion, a first pinion secured to the drive gear to rotate therewith, and a first gear secured on the first end of the drive shaft to rotate therewith, and meshing with the first pinion. The gear train also includes an axle extending through the drive gear and the first pinion.

The portable air blower also comprises a gear cover secured to the one of the two casing halves with a gear casing extension to receive the gear train therein, a handle attached to the housing, and a guide pipe attached to the air outlet of the housing.

Further benefits and advantages of the present invention will become apparent after a careful reading of the detailed description with appropriate reference to the accompanying drawings.

DETAILED DESCRIPTION OF THE INVENTION

Figure 1:
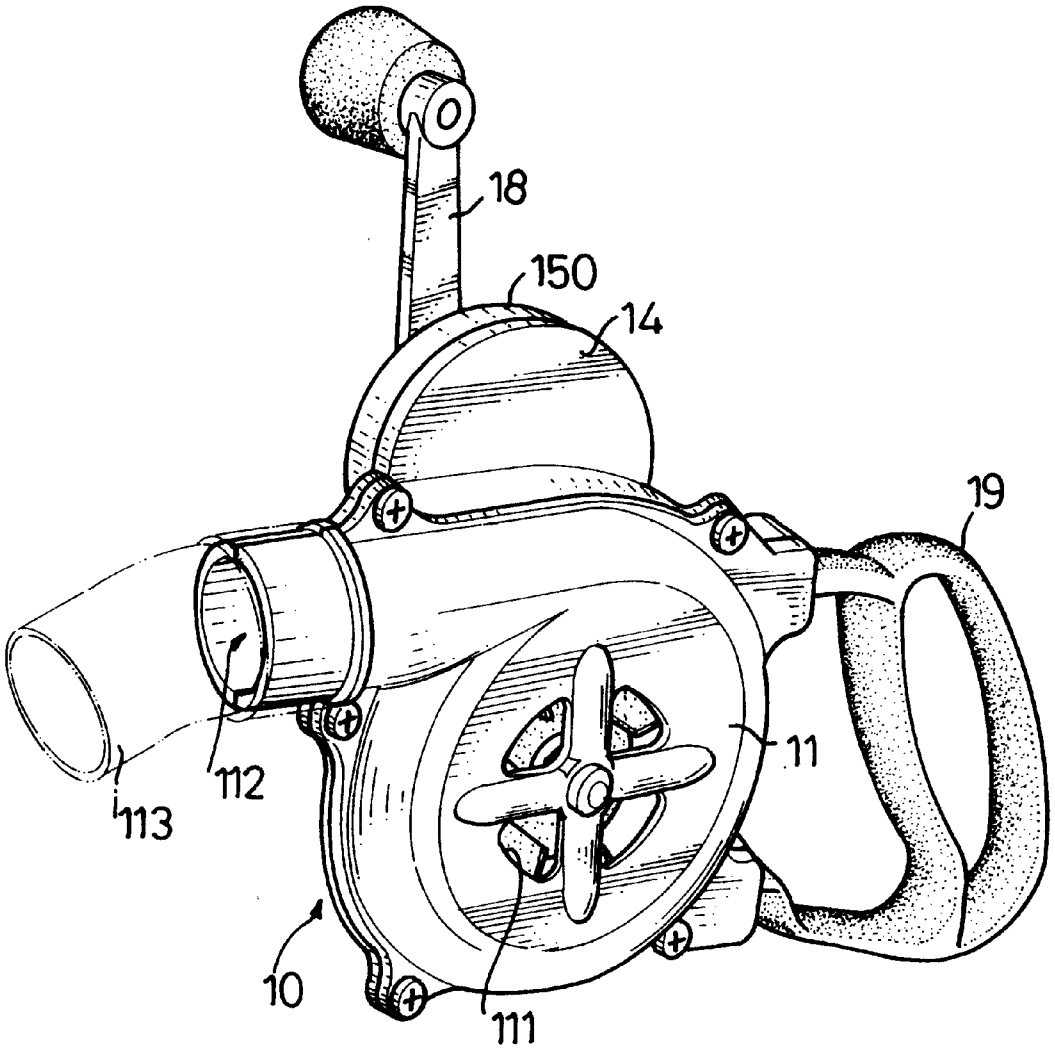
FIG. 1 is a perspective view of a portable air blower in accordance with the present invention.
Figure 2:
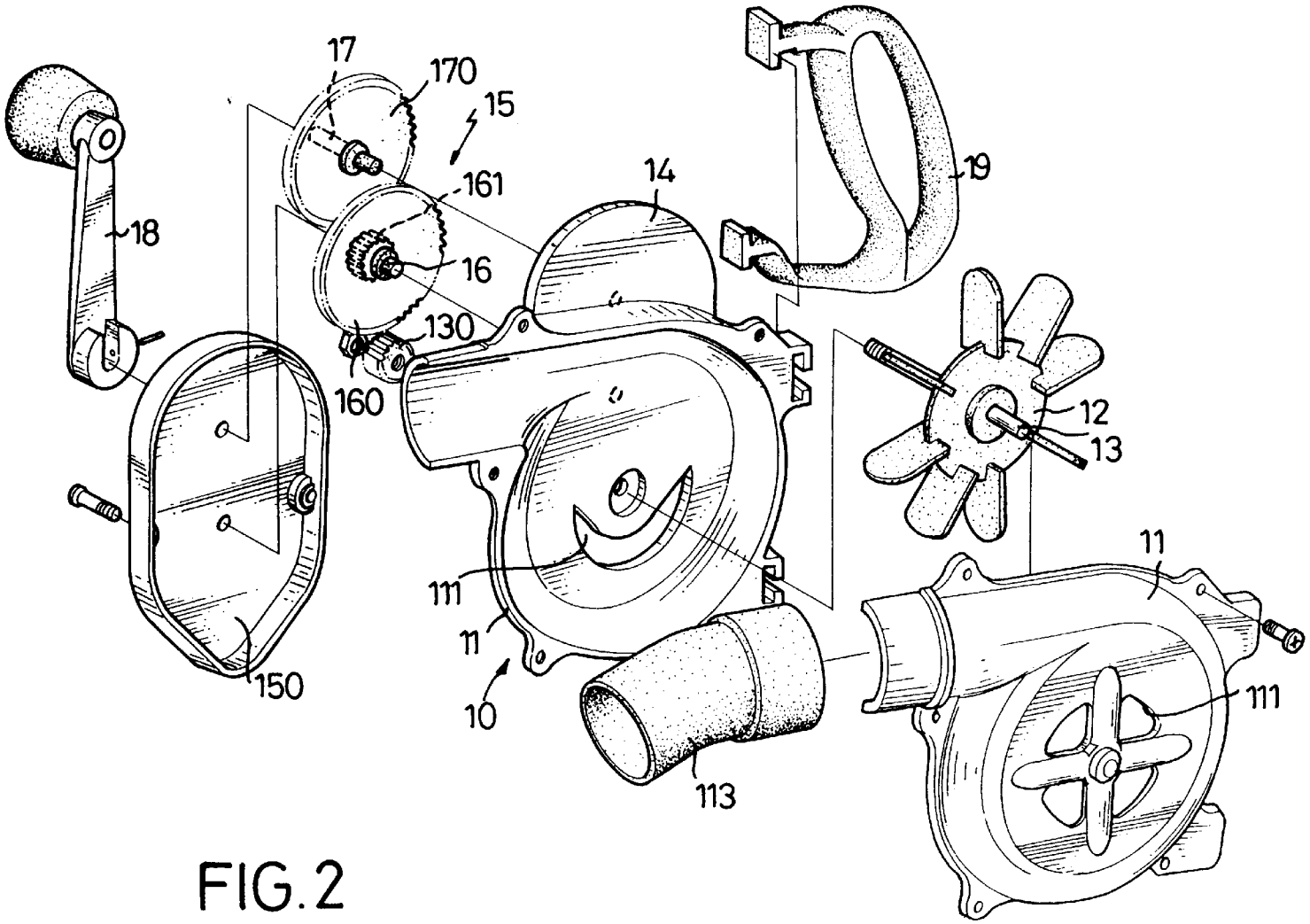
FIG. 2 is an exploded perspective view of the portable air blower as shown in FIG. 1.
Figure 3:
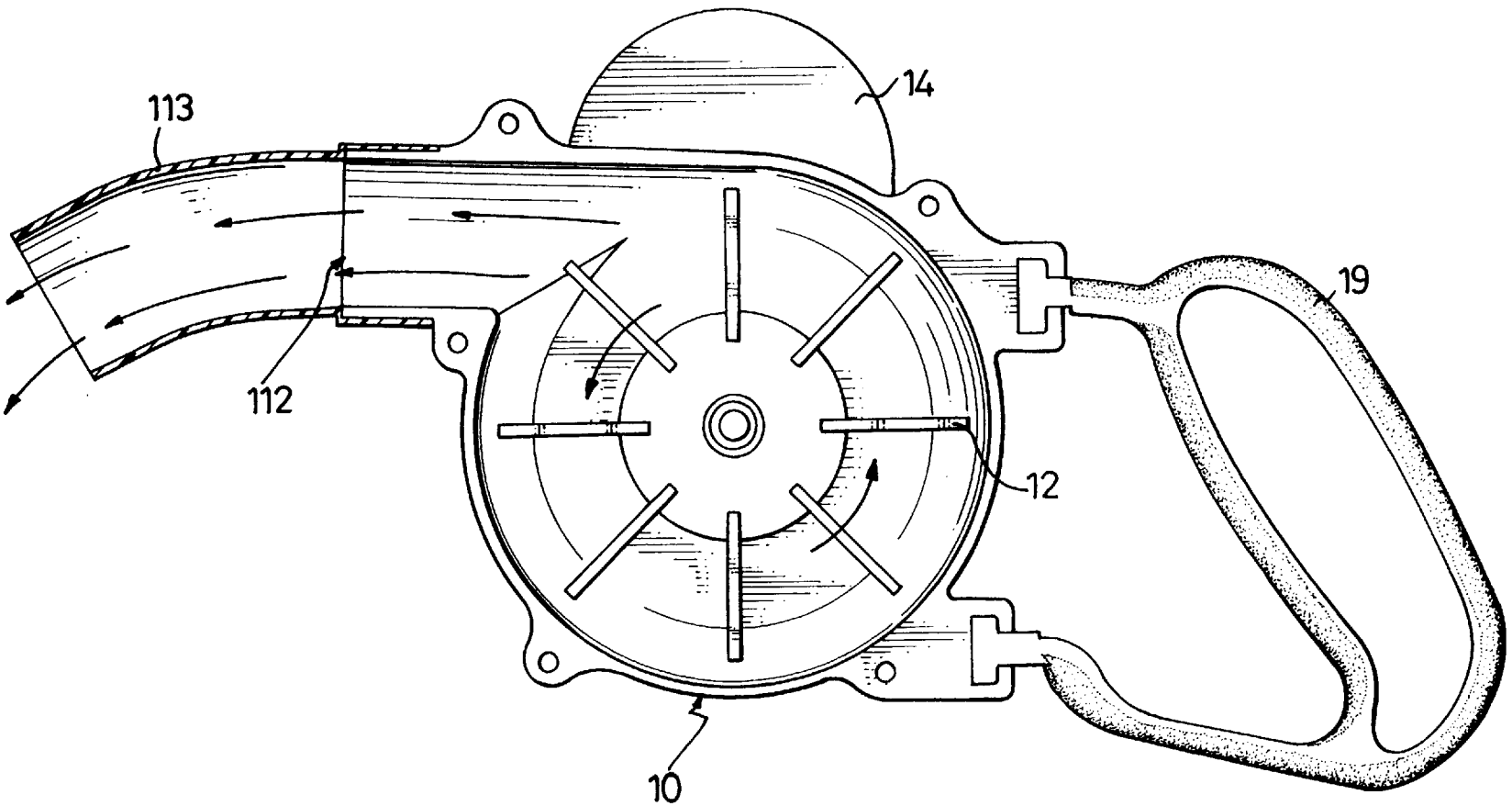
FIG. 3 is a right side plan cross-sectional view of the portable air blower as shown in FIG. 1.
Figure 4:
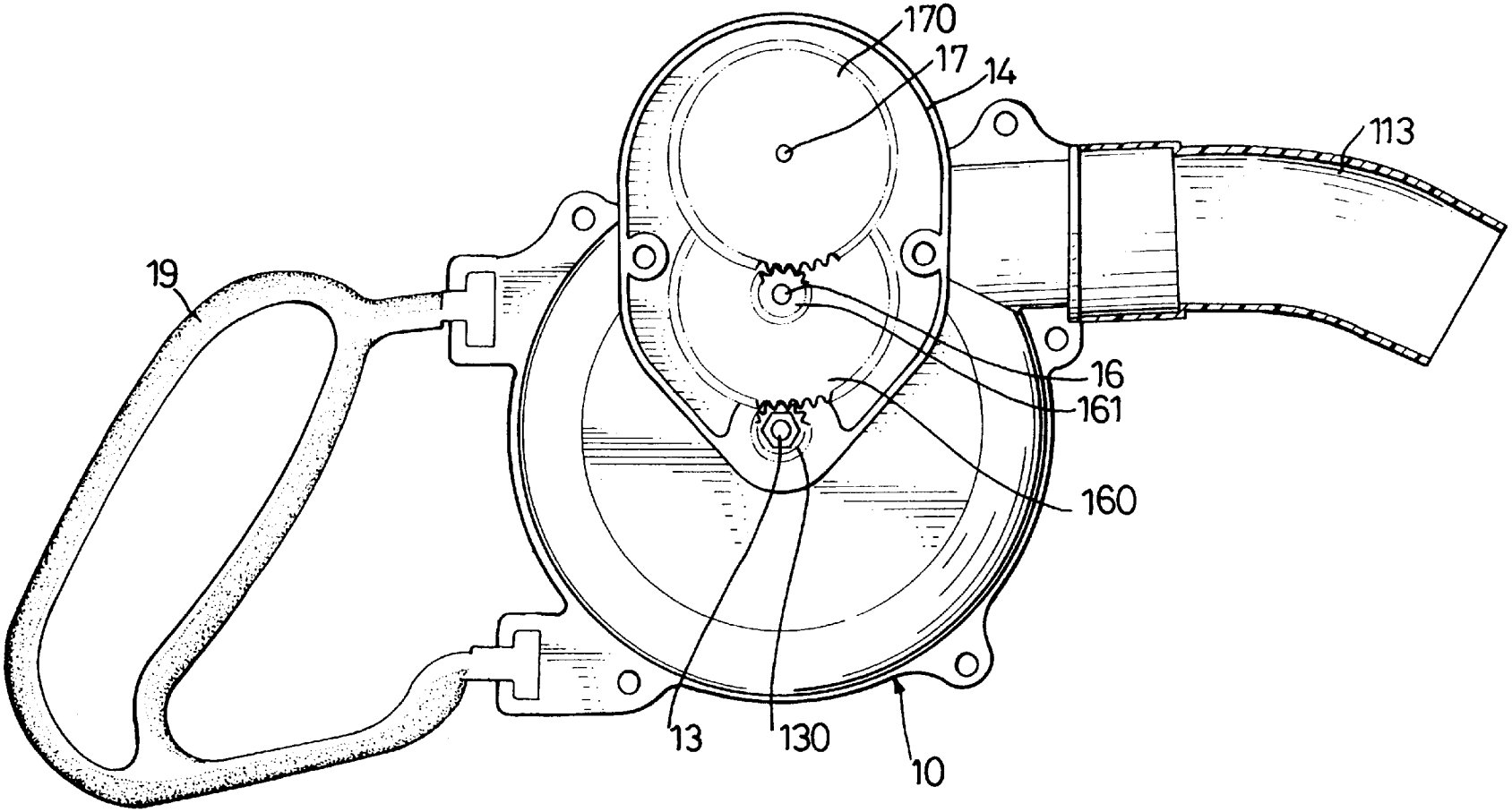
FIG. 4 is a left side plan view in partial section of the portable air blower as shown in FIG. 1.

Referring to the drawings, a portable air blower in accordance with the present invention comprises a housing (10) including an air outlet (112) and two casing halves (11) coupled with each other and each containing an air inlet (111) near the center of the casing half (11), a guide pipe (113) attached to the air outlet (112), a fan (12) rotatably mounted in the housing (10) and located between the two casing halves (11), a gear train (15) attached to the housing (10) to rotate the fan (12), a drive shaft (17) having a first end secured to the housing (10) with the first gear in the gear train (15) securely attached to the drive shaft (17) to operate the gear train (15), a crank arm (18) secured to the second end of the drive shaft (17) to rotate the drive shaft (17), and a handle (19) attached to the housing (10)

The fan (12) includes a driven shaft (13) having a first end secured in the fan (12) to rotate the fan (12), and a second end extending outward through the first casing half (11). The gear train (15) includes a drive pinion (130) secured on the second end of the driven shaft (13) to rotate the driven shaft (13), a drive gear (160) meshing with the drive pinion (130), a first pinion (161) secured to the drive gear (160) to rotate therewith, an axle (16) extending through the drive gear (160) and the first pinion (161), and a first gear (170) secured on the first end of the drive shaft (17) to rotate therewith, and meshing with the first pinion (161).

The portable air blower also comprises a gear cover (150) attached to the first casing (11) to receive the gear train (15) therein. The first casing (11) includes a gear casing extension (14) extending outward and mating with the gear cover (150).

In operation, a user holds the air blower handle (19) with one hand, and rotates the crank arm (18) with the other hand so as to rotate the drive shaft (17) which rotates the first gear (170) which rotates the first pinion (161) which rotates the drive gear (160) which rotates the drive pinion (130) which rotates the driven shaft (13) which then rotates the fan (12) so as to draw air through the airs inlets (111) into the housing (10). The air drawn into the housing (10) is forced outward through the air outlet (112) into the guide pipe (113). In such a manner, the air is blown outward through the guide pipe (113) in a concentrated and powerful manner, thereby assisting the fire in a barbeque grill or the like.

The air blower is portable because it is small, light weight and manually operated, therefore a user can carry and use it outdoors. Because of the gear ratios and sequencing, the two gears (160; 170) working in conjunction with the two pinions (130; 161) can be used to rapidly draw the air into the housing (10) and force the air out of the housing (10) over a wide range of conditions, thereby increasing the versatility of the air blower. Further, the user does not need to expend a lot of energy to rotate the crank arm (18), thereby facilitating the user using the air blower.

It should be clear to those skilled in the art that further embodiments may be made without departing from the scope of the present invention.

What is claimed is:

1. A portable air blower comprising:

a housing having an air outlet and two casing halves coupled with each other, each of said two casing halves having an air inlet near the center of each of said two casing halves;

a fan rotatably mounted in said housing;

a gear train attached to said housing to rotate said fan;

a drive shaft having a first end and a second end, said first end being rotatably mounted to said housing, wherein the first gear of said gear train is securely attached to said drive shaft in said housing to operate said gear train; and a crank arm secured to said second end of said drive shaft to rotate said drive shaft.

2. The portable air blower in accordance with claim 1; wherein said fan includes a driven shaft having said fan secured near one end to rotate said fan and the other end extending out through one of said casing halves, and said gear train includes a drive pinion secured on the opposite end of said driven shaft from said fan to rotate said driven shaft, a drive gear meshing with said drive pinion, a first pinion secured to said drive gear to rotate therewith and a first gear secured on said first end of said drive shaft to rotate therewith, and meshing with said first pinion.

3. The portable air blower in accordance with claim 2, wherein said gear train includes an axle extending through said drive gear and said first pinion.

4. The portable air blower in accordance with claim 2, further comprising a gear cover secured to one of said two casing halves, said gear cover having a gear casing extension to receive said gear train.

5. The portable air blower in accordance with claim 1, further comprising a handle attached to said housing.

6. The portable air blower in accordance with claim 1, further comprising a guide pipe attached to said air outlet of said housing.

* * * * *